United States Patent [19]

Yang

[11] 4,340,559

[45] Jul. 20, 1982

[54] SPINNING PROCESS

[75] Inventor: Hung H. Yang, Richmond, Va.

[73] Assignee: E. I. Du Pont de Nemours and Company, Wilmington, Del.

[21] Appl. No.: 202,737

[22] Filed: Oct. 31, 1980

[51] Int. Cl.[3] ..... D01D 5/14

[52] U.S. Cl. ..... 264/181; 264/184

[58] Field of Search ..... 264/181, 184

[56] References Cited

U.S. PATENT DOCUMENTS 3,767,756 10/1973 Blades ..... 264/184

4,078,034 3/1978 Lewis ..... 264/181

*Primary Examiner*—Jay H. Woo

[57] ABSTRACT

Improved aromatic polyamide fibers from aromatic polyamides whose chain-extending bonds are either coaxial or parallel and oppositely directed are obtained by dry spinneret wet spinning into a shallow coagulating bath having an orifice in its bottom for removal of coagulating liquid and fibers wherein no more than a minor portion of coagulating liquid is lower than the entrance of the bath orifice in the proximity of the bath orifice. Preferably, no more than 10% of the coagulating liquid is lower than the entrance of the bath orifice and most preferably none of the coagulating liquid is lower than the entrance of the bath orifice.

6 Claims, 4 Drawing Figures

FIG. II
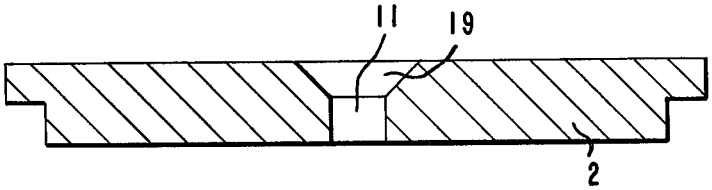
FIG. III
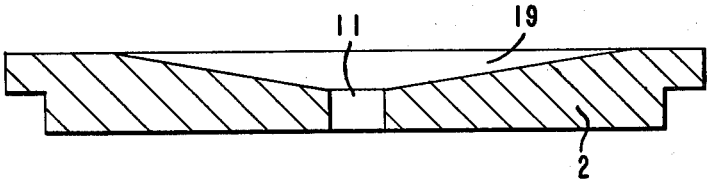
FIG. IV
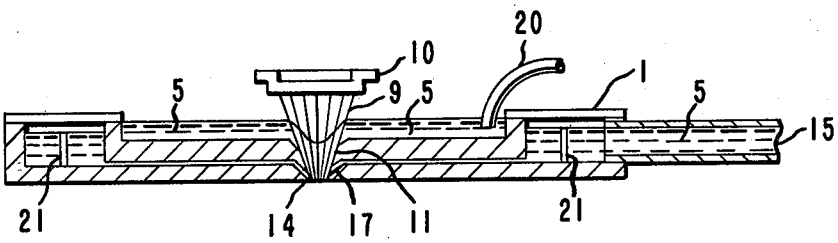

SPINNING PROCESS

This invention relates to an improved process for spinning high strength, high modulus aromatic polyamide filaments at commercially attractive spinning speeds.

BACKGROUND OF THE INVENTION

A process for preparing high strength, high modulus, aromatic polyamide filaments is known from U.S. Pat. No. 3,767,756 whereby highly anisotropic acid solutions of aromatic polyamides whose chain extending bonds are either coaxial or parallel and oppositely directed are extruded through a spinneret into a layer of inert noncoagulating fluid into a coagulating bath and then along with overflowing coagulant through a vertical spin tube aligned with the spinneret. Improved results are obtained if the entrance of the spin tube is provided with a deflecting ring as described in U.S. Pat. No. 4,078,034.

This process provides high strength, high modulus filaments of aromatic polyamides such as poly (p-phenylene terephthalamide) which are useful in the construction of vehicle tires, industrial belts, ropes, cables, ballistic vests, protective clothing and other uses.

Efforts to increase spinning speeds beyond about 500 yds/min cause a reduction in fiber strength, particularly when the denier of the yarn spun is of the order of 1500 denier or more.

Some improvement over the spinning processes of U.S. Pat. Nos. 3,767,756 and 4,078,034 whereby the tenacity of the resulting filaments and yarn is increased, usually by a desirably significant amount of at least 1 g./denier (0.88 dN/tex) at a given spinning speed greater than 250 m/min. is provided by the process described in U.S. Ser. No. 120,888 filed Feb. 12, 1980. However, even further improvement in strength retention at high spinning speeds is desirable.

The present invention provides an improved process for spinning high strength, high modulus aromatic polyamide fibers from aromatic polyamides whose chain extending bonds are either coaxial or parallel and oppositely directed at spinning speeds of up to 2000 m/min. whereby the tension on the spinning threadline is reduced and the tensile strength increased. The fibers produced by the process of the present invention can be processed into tire cords having higher strength than tire cords prepared from similar fibers produced by known processes. The fibers produced by the process of the present invention also have improved strength after aging at high temperature.

BRIEF DESCRIPTION OF THE INVENTION

This invention provides an improved process for spinning high strength, high modulus aromatic polyamide filaments from aromatic polyamides having an inherent viscosity of at least 4.0 whose chain extending bonds are coaxial or parallel and oppositely directed by extruding downwardly an anisotropic solution in 98.0–100.2% sulfuric acid having a polyamide concentration of at least 30 g./100 ml. solvent through a layer of noncoagulating fluid into a coagulating bath whereby overflowing coagulating liquid passes downwardly through an orifice along with the filaments, the filaments are separated from the coagulating liquid, forwarded at 500 to 2,000 m./min., washed, dried, and wound up wherein a shallow bath is used, said bath having sufficient width to provide substantially horizontal, nonturbulent flow of coagulating liquid toward said orifice and having no more than a minor portion of the total coagulating liquid lower than the entrance of said orifice within the area of nonturbulent flow adjacent to said orifice, the shallow bath being of sufficient width to provide a substantially horizontal, nonturbulent flow of coagulating liquid toward said orifice, the orifice having a length to diameter ratio of 3 or less and the cross-sectional area of the orifice being such as to provide a mass flow, ratio of quench liquid/filaments of 25–200. Preferably the volume of coagulating liquid lower than the orifice entrance is less than 10% of the coagulating liquid within the area of nonturbulent flow and most preferably there is no coagulating liquid lower than the orifice entrance. In a preferred process, the orifice is followed immediately by a jet device whereby additional coagulating liquid is applied symmetrically about the filaments in a downward direction forming an angle $\theta$ of 0° to 85° with respect to the filaments within 2.0 milliseconds from the time the filaments enter the orifice, the flow rate of both overflowing coagulating liquid and additional coagulating liquid being maintained at a constant rate such that their momentum ratio $\phi$ is from 0.5 to 6.0 and the mass flow ratio of total quench liquid/filaments is 25–200. Preferably, the depth of the coagulating liquid in the coagulating bath measured from the level of its upper surface to the orifice entrance is less than 1 inch (2.54 cm) and most preferably is less than 0.625 inches (1.6 cm).

BRIEF DESCRIPTION OF THE DRAWINGS

FIG. 2 is a cross-section of an insert which can be used in the coagulating bath of FIG. 1 in replacement of the insert of FIG. 1 which includes the jet device.

FIG. 3 is a cross-section of another insert which can be used in the coagulating bath of FIG. 1 in replacement of the insert of FIG. 1 which includes the jet device.

FIG. 4 is a cross-section of another coagulating bath suitable for use in the process of the present invention.

DETAILED DESCRIPTION

Figure 1:
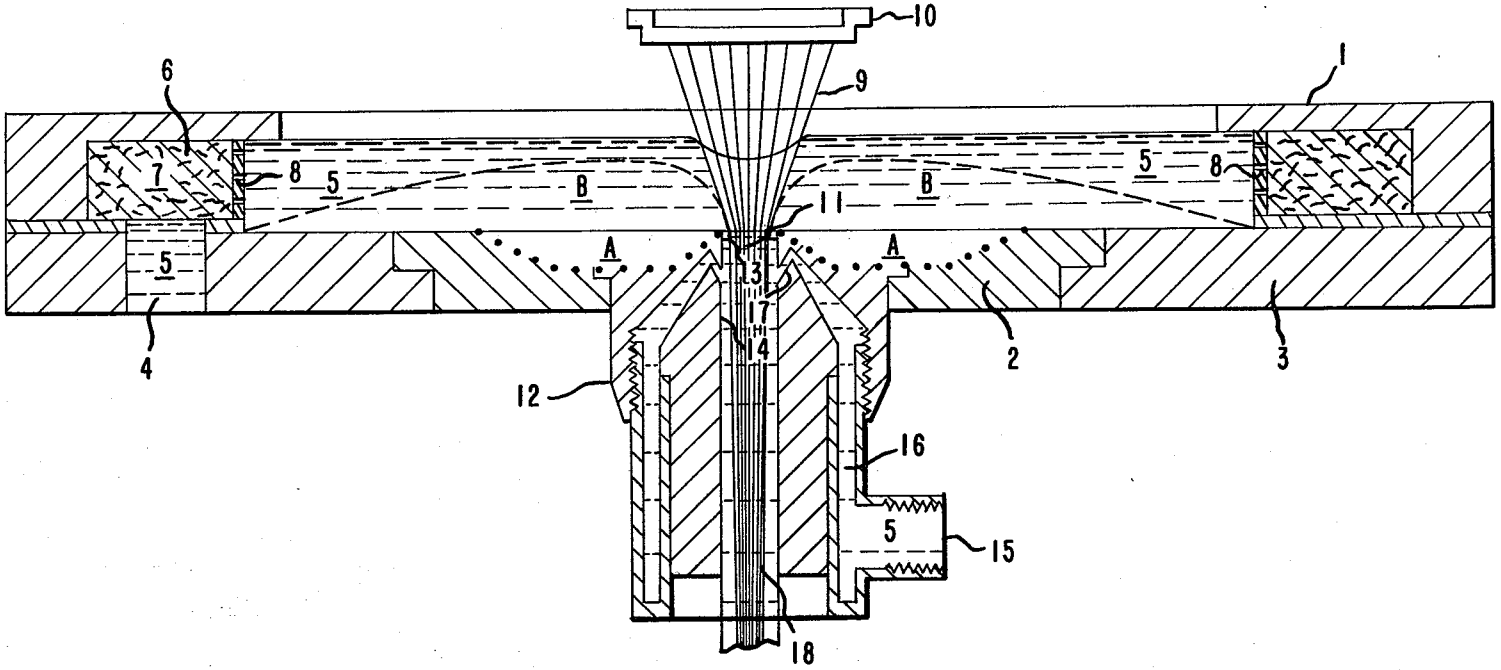
FIG. 1 is a cross-section of a coagulating bath suitable for use in the process of the present invention which optionally includes a following jet device.

The process of the present invention is effective to provide increased tenacity for all para-oriented aromatic polyamide yarns, but usually linear densities are from 20 to 4500 denier (22 to 5,000 dtex) and preferably are 200 to 3,000 denier (222 to 3333 dtex), and linear densities of single filaments are usually from 0.5 to 3.0 denier (0.56 to 3.33 dtex) and preferably are 1.0 to 2.25 denier (1.1 to 2.5 dtex).

The present invention requires uniform, nonturbulent flow of coagulating liquid toward the bath orifice. In a simple coagulating bath without any special means for introducing coagulating liquid to the bath, uniform nonturbulent flow can be accomplished by providing a bath of sufficient width to provide, by gravity flow, uniform, nonturbulent flow of coagulating liquid in the proximity of the orifice. The orifice size should be sufficiently small so that in operation the orifice is filled with coagulating liquid (and filaments) at all times. In order to maintain uniform nonturbulent flow at the orifice, coagulating liquid should be introduced at locations remote from the orifice. Except when a jet device immediately follows the orifice, it is preferred that no tubes or extensions of the orifice be used. The approach to the orifice entrance may be suitably tapered to promote uniform nonturbulent flow. Also, the bottom of the bath may be contoured to promote uniform nonturbulent flow. Preferably the depth of the coagulating bath is no more than 20% of the bath width in the area of nonturbulent flow. Careful vertical alignment of the spinneret and orifice is critical to obtaining the improvement provided by the present invention.

For spinning on a small scale, e.g., 20 filaments, a suitable bath width might be about 2.5 inches (6.35 cm) in combination with an orifice having a diameter (or width) of 3.1 mm which may have a tapered approach having a beginning diameter of about 12 mm. For larger scale spinning, e.g., 1,000 filaments, a suitable bath diameter (or width) might be about 23 cm in combination with an orifice diameter (or width) of 9 mm which may have a tapered approach having a beginning diameter of about 28 mm.

The overflow rate of quench liquid through the orifice is greatly influenced by a moving threadline through the same orifice. For example, the overflow rate through a 0.375 in. (9.5 mm) dia. orifice under a hydrostatic head of 0.625 in. (15.9 mm) is ~0.4 gallons per minute in the absence of a moving threadline, and 2.3 gallons per minute in the presence of a threadline of 1000 filaments of 1.5 denier per filament moving at 686 m./min. This is commonly attributed to the pumping effect of moving filaments through a layer of liquid due to boundary layer phenomena. This effect must be taken into consideration in the selection of the orifice size, i.e. diameter or cross-sectional area.

Introduction of coagulating liquid to the bath may be from a peripheral manifold containing baffles or packing to provide uniform distribution and nonturbulent flow of coagulating liquid toward the orifice. In the case of a circular bath, the manifold can surround the bath. In the case of a rectangular bath with a slot orifice, the manifold can still surround the bath but coagulating liquid would be provided only on the sides of the bath which are parallel to the slot. It is necessary only that the flow of coagulating liquid toward the orifice be nonturbulent in the proximity of the orifice.

When the coagulating bath of the present invention is used along with a jet device, the minor cross-sectional dimension of the jet (e.g., hole diameter or slot width) is generally in the range of 2 to 100 mils (0.05 to 2.5 mm), preferably in the range of 5 to 20 mils (0.13 to 0.51 mm). Likewise the average velocity of jetted coagulating liquid may be as much as 150% of that of the yarn being processed, but it preferably does not exceed about 85% of the yarn velocity. However, the jet device provides improvement only when the spinneret, spin orifice, jet and any extension of the spin tube are carefully aligned on the same axis and only when the jet elements are carefully designed and aligned to provide perfectly symmetrical jetting about the threadlines. Any misalignment of jet elements or the lodging of any solid particles in jet openings so as to destroy perfect symmetry will reduce or eliminate the improvements. Such symmetry may be provided from two or more jet orifices, or from slots symmetrically spaced with respect to the thread line.

Typical operation of the process of the present invention is described with reference to FIG. 1 which is a cross-section of a coagulating bath 1 which is a circular structure consisting of an insert disc 2 fitted into supporting structure 3. Supporting structure 3 includes an inlet 4 for introduction of quench liquid 5 under pressure into distribution ring 6 which contains a filler 7 suitable to enhance uniform delivery of quench liquid around the periphery of the coagulating bath 1. The filler 7 may be glass beads, a series of screens, a honeycomb structure, sintered metal plates, or other similar device. After passing through the filler 7, the quench liquid passes through perforated plate or screen 8 and flows uniformly without appreciable turbulence or back mixing horizontally toward the center of bath 1 where the quench liquid 5 contacts filaments 9 extruded from spinneret 10 whereby both quench liquid 5 and filaments 9 pass together through orifice 11 (which may include a tapered approach 19 as shown in FIGS. 2 and 3) in a downward direction. Insert disc 2 may include circular jet device 12. The entrance of the jet device coincides with opening 11 and may have a lip 13 to help keep filaments 9 from adhering to the walls of orifice 11 and tube 14. Quench liquid 5 is introduced through opening 15 through passageway 16 to jet opening 17 whereby the quench liquid 5 passes along with filaments 9 and other quench liquid 5 in a downward direction through exit 18 toward a forwarding device. Before wind-up, the filaments may be washed and/or neutralized and dried.

The bath may have a depressed area A around orifice 11 or the bottom of the bath may be flat as when area A is filled in. In a preferred embodiment, the bath may have a contoured bottom as shown by raised area B over filled-in area A.

Alternatively, insert disc 2 of FIG. 1 including the jet device may be replaced by the insert disc of FIG. 2 having a tapered entrance 19 or by the insert disc of FIG. 3 having a widely tapered entrance.

FIG. 4 shows a cross-section of a coagulating bath of the invention including a jet device wherein the bath and jet are combined in a unitary structure having coagulating liquid inlet 20 and baffle 21 to promote uniform flow in the jet.

TEST PROCEDURES

Yarn properties are measured at 24° C. and 55% relative humidity on yarns which have been conditioned under the test conditions for a minimum of 14 hours. Before tests, each yarn is twisted to a 1.1 twist multiplier (e.g., nominal 1500 denier [1670 dtex] yarn is given a twist of about 0.8 turn/cm). Tenacity is measured on 25.4 cm length at 50% strain/minute. Linear densities are calculated from weights of known lengths of yarn corrected to a finish-free basis including 4.5% moisture.

Inherent viscosity ($\eta$inh) at 30° C. is computed from:

$\eta inh = \ln(t_1/t_2)/c$ where $t_1$ = solution flow time in the viscometer, $t_2$ = solvent flow time in the viscometer and c = polymer concentration of 0.5 gm/dL and the solvent is 96% $H_2SO_4$.

For determining $\eta$inh of yarn, the "polymer" is a section of yarn.

JET MOMENTUM RATIO ($\phi$)

The momentum ratio is defined as the ratio of momentum ($M_2$) along the threadline direction for jetted coagulating liquid to momentum ($M_1$) of the overflowing coagulating liquid; i.e., $\phi = M_2/M_1$. Momentum is defined as the product of the mass-rate and the velocity of flow. Calculation of momentum ratio is described in the aforementioned U.S. Ser. No. 120,888 filed Feb. 12, 1980 and in the examples is computed from $$\phi = \frac{Q_2^2 \cos\theta}{4\,Q_1^2} \times \frac{d_1^2}{d_2\,(d_1 + d_2 \cos\theta)}$$

wherein $Q_1$ is the flow of overflowing liquid $Q_2$ the flow of jetted liquid, $d_1$ is the orifice diameter or width $d_2$ is the minor dimension of the jet opening $\theta$ is the angle between the jetted liquid and the threadline.

As long as $d_1$ and $d_2$, and $Q_1$ and $Q_2$, are in the same units, the ratio $\phi$ is independent of the units selected.

RATIO OF MASS-FLOW RATES

This is the ratio of mass-flow rate of total coagulating liquid to mass-flow rate of filaments. The basic unit of liquid flow rate Q herein is in gal./min.

$$Q \times 3899 = \text{mass-flow in gm/min.}$$

For yarn, basic units are speed Y in yd/min and denier D in gm/ (9000).

$$YD \times \frac{.9144}{9000} = \text{mass-flow in gm/min.}$$

The ratio then becomes $$\frac{Q}{YD} \times \frac{3899 \times 9000}{0.9144} = \frac{Q}{YD} \times 3.8376 \times 10^7$$

In these derivations it is assumed that density of coagulating liquid is about 1.03 g/ml.

TWIST MULTIPLIER

The twist multiplier (TM) correlates twist per unit of length with linear density of the yarn (or cord) being twisted. It is computed from $TM = (\text{Denier})^{1/2}(\text{tpi})/73$ where tpi = turns per inch, and $TM = (\text{dtex})^{1/2}(\text{tpc})/30.3$ where tpc = turns per centimeter.

HEAT AGED BREAKING STRENGTH (HABS)

Heat-aged breaking strength (HABS) is obtained by measuring tenacity after heating yarns twisted to a twist multiplier of 1.1 in relaxed condition at a temperature of 240° C. for 3 hours. Data in Table III confirm that the tenacity improvement of this invention persists through heat-aging.

DIPPED CORD TENSILE STRENGTH

Yarns of Examples X–XV were twisted to a twist multiplier of 6.5 in one direction and then 3-plied at a twist multiplier of 6.5 in the opposite direction to form 1500/1/3 cords. These cords were dipped in an epoxy subcoat at 1.0 gpd tension and dried followed by dipping in a standard RFL latex formulation at 0.3 gpd and dried, and then tested for tenacity. Results are listed under dipped cord tensile in Table III and confirm that the tenacity improvement of this invention persists after conversion to tire cords.

COAGULATION BATHS

In the following examples, the coagulating baths used are as follows:

Tray A corresponds to a square bath having an inside width of 2.25 inches (5.7 cm) as shown in FIG. 1 except that coagulating liquid is introduced at one corner of the bath and except that the insert disc 2 is replaced by the insert disc of FIG. 2 having an orifice diameter of 0.125 inches (3.175 mm) and a length of 0.125 inches (3.175 mm) with a tapered approach having a beginning diameter of 0.5 inches (12.7 mm).

Tray B corresponds to tray A except that the orifice diameter is 0.15 inches (3.81 mm).

Tray C corresponds to a square bath having an inside width of 2.25 inches (5.7 cm) and having the cross-section of FIG. 1 except that an insert disc corresponding to the cross-section of FIG. 2 is used but the orifice is a slot. The slot width is 0.0625 inches (1.59 mm) and the slot length is 1.5 inches (38 mm).

Tray D corresponds to a circular bath having an inside diameter of 2.25 inches (6.35 cm) as shown in FIG. 4 having an orifice diameter of 0.15 inches (3.81 mm) and a length of 0.125 inches (3.175 mm) and a contoured approach as shown in FIG. 4. Tray E corresponds to a circular bath having an inside diameter of 6.5 inches (16.5 cm) as shown in FIG. 1 (dotted line for insert), except no jet is present, having an orifice diameter of 0.375 inches (9.5 mm) and a length of 0.5 inches (1.27 cm), but no tapered approach.

Tray F corresponds to a circular bath having an inside diameter of 6.5 inches (16.5 cm) as shown in FIG. 1 with a bottom corresponding to the dotted line in FIG. 1 and having an orifice diameter of 0.375 inches (9.5 mm).

Tray G is the same as Tray F except the bottom corresponds to the dashed line in FIG. 1.

Tray H corresponds to Tray F having a bottom as indicated by the solid line.

SPINNING SOLUTIONS

In the following examples, the spinning solutions are 19.4±0.1% (by weight) poly (p-phenylene terephthalamide) in 100.1% $H_2SO_4$ as solvent.

SPINNING

The spinning solution at 70° to 80° C. is extruded through a spinneret. The extruded filaments usually pass first through an air gap of 0.25 inch (0.64 cm) and then through a coagulating liquid maintained at 0° to 5° C. and consisting of water containing 0 to 4% by weight $H_2SO_4$. In Examples I through VII and IX the coagulating liquid is water. In the other examples the coagulating liquid is 3–4% aqueous $H_2SO_4$. The coagulated filaments are forwarded (defined as spinning speed), washed, neutralized, dried and wound up.

For some of the examples the spinneret employed has 20 orifices and in others the spinneret employed has 1,000 orifices within a circle of 0.4 inches (1.02 cm) and 1.5 inches (3.8 cm) in diameter, respectively. When different numbers of filaments were spun, the diameter of the circle of orifices was varied to provide substantially equal orifice size and spacing. In the examples L/D is the length to diameter ratio of the capillaries having the indicated diameter. The quench depth is the distance from the coagulating bath surface to the orifice with the maximum bath depth including the depth below the level of the orifice indicated in parentheses. In Trays A, B and D the quench depth given is from the coagulating bath surface to the flat bottom from which the tapered approach to the orifice begins. The air gap is the thickness of the layer of noncoagulating fluid.

Quench flow is in grams/minute for those spins using 20 hole spinnerets and in gallons/minute for those spins using 1,000 hole spinnerets. Quench/polymer flow ratio is the ratio of the mass flow rate of the total coagulating liquid (including jet flow where present) to the mass flow rate of the filaments (dry weight).

Spinning tension is measured after a change of direction pin at a suitable distance directly under the orifice of the quench bath.

EXAMPLE I

In this example a coagulating bath corresponding to the bath shown in FIG. 1 of U.S. Pat. No. 3,869,429 is compared with Tray A. Conditions and results are shown in Table 1.

EXAMPLE II

In this example Tray A is compared with the bath used in Example I first having an exit tube having a diameter of 0.25 inches (6.35 mm.) and 4 inches (101.6 mm.) long, and then having an exit tube having a diameter of 0.75 inches (1.9 cm) 4 inches (101.6 mm.). Conditions and results are shown in Table I.

EXAMPLE III

In this example, Tray A is used with a different spinneret than the one used in Example II. Conditions and results are shown in Table I.

EXAMPLE IV

In this example, the width of the air gap and denier per filament are varied while spinning using Tray A. Conditions and results are shown in Table II.

EXAMPLE V

In this example, Tray A is used at a spinning speed of 1829 m/min. Yarn properties are for several 20 filament, nominally 30 denier, yarns plied together. Conditions and results are shown in Table II.

EXAMPLE VI

In this example, Tray B is used at a spinning speed of 1829 m/min. Conditions and results are shown in Table II.

EXAMPLE VII

In this example, Tray A is used at a spinning speed of 1726 m/min. Conditions and results are shown in Table II.

EXAMPLE VIII

In this example, a coagulating bath corresponding to the bath shown in FIG. 1 of U.S. Pat. No. 4,078,034 is compared to Tray D at spinning speeds of 457, 686 and 914 m/min. Conditions and results are shown in Table II.

EXAMPLE IX

In this example, spinning at 457 m/min. using Tray A is compared with spinning at 457 m./min and 914 m/min. at two different quench/polymer flow ratios using Tray D. Conditions and results are shown in Table II.

EXAMPLE X

In this example, a coagulating bath corresponding to the bath shown in FIG. 1 of U.S. Pat. No. 4,078,034 is compared with Tray E at a spinning speed of 608 m/min. Conditions and results are shown in Table III.

EXAMPLE XI

In this example, coagulating baths corresponding to FIG. 1 of U.S. Ser. No. 120,888 filed Feb. 12, 1980 and FIG. 1 of U.S. Pat. No. 4,078,034 are compared with Tray F. Conditions and results are shown in Table III.

EXAMPLE XII

In this example, spinning at 411 m/min. is shown using Tray F. Conditions and results are shown in Table III.

EXAMPLE XIII

In this example, use of Trays F, G and H is compared at a spinning speed of 686 m/min. Conditions and results are shown in Table III.

EXAMPLE XIV

In this example, Tray G is used at a spinning speed of 686 m/min. using a lower jet flow than in example XIII.

EXAMPLE XV

In this example, Tray F without the jet in operation is compared with Tray F with the jet in operation. Conditions and results are shown in Table III.

EXAMPLE XVI

In this example, Tray E is used in comparison with an identical tray having an orifice length of 2.0 inches (5.08 cm.).

It can be seen that significantly improved filaments can be obtained using the process of the present invention. Particularly good results are obtained at high spinning speeds up to 1829 m/min.

TABLE I

| Ex. | Spin Speed m/min | Spinneret no. holes (dia. mm × L/D) | Quench Device | Quench Depth, mm | Air Gap mm | Polymer ηinh | Quench Flow* | Tension gpd | Jet Flow gal/min | Quench/Polymer Flow Ratio | Jet Momentum Ratio |
|---|---|---|---|---|---|---|---|---|---|---|---|
| I | 457 | 20 (.076 × 3) | Bath | 4.76 (79.4) | 9.525 | 5.2 | >300 | — | — | >212 | — |
| | 457 | 20 (.076 × 3) | Tray A | 3.17 (79.4) | 12.7 | " | 300 | 0.417 | — | 197 | — |
| II | 457 | 20 (.064 × 2.8) | Bath 1.9 cm tube | 3.17 (79.4) | 12.7 | " | >300 | 0.71 | — | >182 | — |
| | 914 | 20 (.064 × 2.8) | Bath 1.9 cm tube | " | 19.05 | " | " | 1.31 | — | >107 | — |
| | 1371 | 20 (.064 × 2.8) | Bath 1.9 cm tube | " | 25.4 | " | " | 1.55 | — | >68 | — |
| | 1829 | 20 (.064 × 2.8) | Bath 1.9 cm tube | " | 25.4 | " | " | 2.13 | — | >66 | — |

TABLE I-continued

| | | | | | | | | | | | |
|---|---|---|---|---|---|---|---|---|---|---|---|
| | 457 | 20 (.064 × 2.8) | Tray A | 3.17 | 12.7 | " | 250 | 0.32 | — | 166 | — |
| | 918 | 20 (.064 × 2.8) | " | " | 19.05 | " | 250 | 0.63 | — | 96 | — |
| | 1371 | 20 (.064 × 2.8) | " | " | 25.4 | " | 230 | 0.81 | — | 55 | — |
| | 1836 | 20 (.064 × 2.8) | " | " | 25.4 | " | 200 | 0.86 | — | 31 | — |
| | 457 | 20 (.064 × 2.8) | Bath 0.635 cm tube | 3.17 (79.4) | 12.7 | " | >300 | 0.39 | — | >155 | — |
| | 914 | 20 (.064 × 2.8) | Bath 0.635 cm tube | " | 19.05 | " | " | 1.45 | — | >110 | — |
| | 1371 | 20 (.064 × 2.8) | Bath 0.635 cm tube | " | 25.4 | " | " | 1.85 | — | >55 | — |
| | 1829 | 20 (.064 × 2.8) | Bath 0.635 cm tube | " | 25.4 | " | " | 2.05 | — | >31 | — |
| III | 457 | 20 (.076 × 3) | Tray A | 3.17 | 12.7 | " | 250 | 0.27 | — | 149 | — |
| | 914 | 20 (.076 × 3) | " | " | 19.05 | " | 250 | 0.81 | — | 91 | — |
| | 1371 | 20 (.076 × 3) | " | " | 25.4 | " | 230 | 1.13 | — | 57 | — |
| | 1829 | 20 (.076 × 3) | " | " | 31.75 | " | 200 | 1.01 | — | 28 | — |

| Ex. | Quench Device | Spin Speed m/min | Yarn Denier | Tenacity gpd | Elongation % | Modulus gpd |
|---|---|---|---|---|---|---|
| I | Bath | 457 | 27.8 | 21.3 | 2.9 | 713 |
| | Tray A | 457 | 30.0 | 26.6 | 3.7 | 603 |
| II | Bath 1.9 cm tube | 457 | 32.5 | 22.7 | 3.5 | 576 |
| | Bath 1.9 cm tube | 914 | 27.5 | 21.1 | 3.4 | 552 |
| | Bath 1.9 cm tube | 1371 | 29.0 | 19.9 | 3.7 | 488 |
| | Bath 1.9 cm tube | 1829 | 22.5 | 17.5 | 3.9 | 436 |
| | Tray A | 457 | 29.7 | 24.9 | 4.1 | 491 |
| | " | 914 | 25.6 | 21.1 | 3.7 | 476 |
| | " | 1371 | 27.2 | 20.4 | 4.0 | 448 |
| | " | 1829 | 31.3 | 18.7 | 4.0 | 423 |
| | Bath 0.635 cm tube | 457 | 38.0 | 21.6 | 3.9 | 470 |
| | Bath 0.635 cm tube | 914 | 26.9 | 16.3 | 3.1 | 516 |
| | Bath 0.635 cm tube | 1371 | 29.8 | 11.5 | 3.0 | 393 |
| | Bath 0.635 cm tube | 1829 | 34.1 | 14.9 | 3.3 | 412 |
| III | Tray A | 457 | 33.0 | 24.9 | 4.2 | 493 |
| | " | 914 | 27.0 | 21.7 | 3.7 | 529 |
| | " | 1371 | 26.5 | 21.6 | 4.3 | 463 |
| | " | 1829 | 35.5 | 20.9 | 4.4 | 416 |

TABLE II

| Ex. | Spin Speed m/min | Spinneret no. holes (dia. mm × L/D) | Quench Device | Quench Depth, mm | Air Gap mm | Polymer ηinh | Quench Flow* | Tension gpd | Jet Flow gal/min | Quench/Polymer Flow Ratio | Jet Momentum Ratio |
|---|---|---|---|---|---|---|---|---|---|---|---|
| IV | 457 | 20 (.076 × 3) | Tray A | 3.17 | 12.7 | 5.2 | 250 | — | — | 149 | — |
| | 457 | 20 (.076 × 3) | " | " | 31.75 | " | " | — | — | 43 | — |
| | 457 | 20 (.076 × 3) | " | " | 25.4 | " | " | — | — | 59 | — |
| | 457 | 20 (.076 × 3) | " | " | 19.05 | " | " | — | — | 88 | — |
| V | 1829 | 20 (.064 × 2.8) | Tray A | 3.17 | 12.7 | " | 200 | — | — | 33 | — |
| VI | 1829 | 20 (.076 × 3) | Tray B | 3.17 | 19.05 | " | 200 | — | — | 30 | — |
| VII | 1726 | 20 (.064 × 2.8) | Tray A | 3.17 | 12.7 | " | 200 | — | — | 36 | — |
| VIII | 457 | 1000 (.064 × 1.5) | Bath | 22.23(158.8) | 6.35 | " | 5.0 | 0.35 | — | 256 | — |
| | 686 | 1000 (.064 × 1.5) | " | 19.05(158.8) | " | " | 5.2 | 0.47 | — | 177 | — |
| | 914 | 1000 (.064 × 1.5) | " | 15.88(158.8) | " | " | 3.85 | >0.67 | — | 98 | — |

TABLE II-continued

| | | | | | | | | | | | |
|---|---|---|---|---|---|---|---|---|---|---|---|
| | 457 | 1000 (.064 × 1.5) | Tray C | 6.35 | 9.53 | " | 4.0 | 0.28 | — | 205 | — |
| | 686 | 1000 (.064 × 1.5) | " | " | 12.7 | " | 4.0 | 0.46 | — | 136 | — |
| | 914 | 1000 | " | " | 12.7 | " | 4.0 | >0.67 | — | 102 | — |
| IX | 457 | 20 (.064 × 2.8) | Tray A | 3.175 | 6.35 | " | 250 | — | — | 170 | — |
| | 457 | | Tray D | " | " | " | " | — | Not measured | >179 | >0 |
| | 914 | | " | " | " | " | " | — | Not measured | >84 | >0 |

| Ex. | Quench Device | Spin Speed m/min | Yarn Denier | Tenacity gpd | Elongation % | Modulus gpd |
|---|---|---|---|---|---|---|
| IV | Tray A | 457 | 33.0 | 24.9 | 4.2 | 493 |
| | " | 457 | 114.0 | 17.1 | 4.6 | 329 |
| | " | 457 | 83.5 | 23.2 | 4.7 | 320 |
| | " | 457 | 56.0 | 23.3 | 4.5 | 404 |
| V | Tray A | 1829 | 1368(plied) | 21.1 | 4.8 | 398 |
| VI | Tray B | 1829 | 1.63[a] | 25.3[a] | 6.3[a] | 436[a] |
| VII | Tray A | 1726 | 28.6 | 23.4 | 4.0 | 524 |
| VIII | Bath | 457 | 1.95[a] | 29.0[a] | 5.7[a] | 589[a] |
| | " | 686 | 1.85[a] | 25.7[a] | 4.8[a] | 593[a] |
| | " | 914 | 1.99[a] | 22.8[a] | 5.5[a] | 463[a] |
| | Tray D | 457 | 1.62[a] | 26.0[a] | 4.9[a] | 493[a] |
| | " | 686 | 1.53[a] | 27.1[a] | 5.0[a] | 508[a] |
| | " | 914 | 1.60[a] | 23.1[a] | 5.0[a] | 415[a] |
| IX | Tray A | 457 | 29.0 | 25.4 | 3.8 | 535 |
| | Tray D | 457 | 27.5 | 25.2 | 3.9 | 522 |
| | " | 914 | 29.3 | 24.6 | 4.2 | 469 |

[a]filament properties

TABLE III

| Ex. | Spin Speed m/min | Spinneret no. holes (dia. mm × L/D) | Quench Device | Quench Depth, mm | Air Gap mm | Polymer ηinh | Quench Flow* | Tension gpd | Jet Flow gal/min | Quench/Polymer Flow Ratio | Jet Momentum Ratio | Jet Opening Min. |
|---|---|---|---|---|---|---|---|---|---|---|---|---|
| X | 608 | 1000 (.064 × 2.8) | Bath/Rim | 15.9(158.8) | 6.35 | 5.6 | 4.25 | — | — | 159 | — | — |
| | 608 | 1000 (.064 × 2.8) | Tray E | 15.9(21.9) | " | " | 2.0 | — | — | 73 | — | — |
| XI | 686 | 1000 (.064 × 2.8) | Bath/Jet | 15.9(158.8) | 6.35 | 5.6 | 2.0 | 0.27 | 1.0 | 102 | 1.65 | 0.30 |
| | 686 | 1000 (.064 × 2.8) | Tray F | 15.9(21.9) | " | " | 2.0 | 0.23 | 1.0 | 102 | 1.65 | 0.30 |
| | 549 | 1000 (.064 × 2.8) | Bath/Rim | 15.9(158.8) | " | " | 2.5 | 0.51 | 0 | 107 | — | — |
| XII | 411 | 1000 (.064 × 2.8) | Tray F | 15.9(21.9) | 6.35 | 5.6 | 3.0 | 0.10 | 1.25 | 123 | 1.14 | 0.30 |
| XIII | 686 | 1000 (.064 × 2.8) | Tray F | 15.9 | 6.35 | 5.6 | 1.95 | 0.21 | 1.5 | 116 | 3.90 | 0.30 |
| | " | 1000 (.064 × 2.8) | Tray G | " | " | " | " | 0.21 | " | 116 | 3.90 | 0.30 |
| | " | 1000 (.064 × 2.8) | Tray H | " | " | " | 1.9 | 0.19 | " | 117 | 4.10 | 0.30 |
| XIV | 686 | 1000 (.064 × 2.8) | Gray G | 15.9 | 6.35 | 5.6 | 1.95 | 0.19 | 1.0 | 98 | 1.73 | 0.30 |
| XV | 686 | 1000 (.064 × 2.8) | Tray F | 15.9(21.9) | 6.35 | 5.6 | 3.5 | 0.33 | 0 | 119 | 0 | — |
| | " | 1000 (.064 × 2.8) | " | " | " | " | 2.75 | 0.23 | 0.75 | 119 | 0.99 | 0.15 |
| XVI | 686 | 1000 (0.64 × 2.8) | Tray E | 15.9(21.9) | 6.35 | 5.6 | 3.0 | — | — | 105 | — | — |
| | " | 1000 (0.64 × 2.8) | Tray E Modified | " | " | " | 3.0 | — | — | 97 | — | — |

| Ex. | Quench Device | Spin Speed m/min | Yarn Denier | Tenacity gpd | Elongation % | Modulus gpd | HABS, lbs | Dipped Cord Tensile,gpd |
|---|---|---|---|---|---|---|---|---|
| X | Bath/Rim | 608 | 1543 | 21.3 | 3.7 | 494 | 58.0 | 17.7 |
| | Tray E | 608 | 1572 | 21.9 | 4.2 | 436 | 63.0 | 18.1 |
| XI | Bath/Jet | 686 | 1500 | 22.8 | 3.6 | 592 | 59.2 | 18.4 |
| | Tray F | 686 | 1500 | 23.2 | 3.8 | 566 | 61.6 | 18.8 |
| | Bath/Rim | 549 | 1500 | 22.1 | 3.5 | 554 | 57.0 | 17.7 |
| XII | Tray F | 411 | 2943 | 24.0 | 4.1 | 507 | 62.4 | 18.3 |
| XIII | Tray F | 686 | 1520 | 21.9 | 3.6 | 518 | 61.8 | 18.1 |
| | Tray G | 686 | 1518 | 23.2 | 3.8 | 525 | 57.4 | 19.3 |
| | Tray H | 686 | 1482 | 24.3 | 4.1 | 515 | 62.0 | 19.5 |
| XIV | Tray G | 686 | 1544 | 24.7 | 4.0 | 528 | 63.8 | — |

TABLE III-continued

| | | | | | | | | |
|---|---|---|---|---|---|---|---|---|
| XV | Tray F | 686 | 1500 | 22.3 | 3.5 | 539 | 58.1 | 18.1 |
| | Tray F | 686 | 1500 | 23.8 | 3.8 | 545 | 59.5 | 18.7 |
| XVI | Tray E | 686 | 1463 | 22.8 | 4.0 | 508 | — | — |
| | Tray E | 686 | 1579 | 21.3 | 4.1 | 463 | — | — |

*20 hole spinneret g/min, 1000 hole spinneret gallons/min
**HABS = heat aged breaking strength

What is claimed is:

1. A process for spinning high strength, high modulus aromatic polyamide filaments from aromatic polyamides having an inherent viscosity of at least 4.0 whose chain extending bonds are coaxial or parallel and oppositely directed by extruding downwardly an anisotropic solution in 98.0–100.2% sulfuric acid having a polyamide concentration of at least 30 g/100 ml solvent through a layer of noncoagulating fluid into a coagulating bath whereby overflowing coagulating liquid passes downwardly through an orifice along with the filaments, the filaments are separated from the coagulating liquid, forwarded at 500 to 2,000 m/min., washed, dried and wound up, wherein a shallow bath is used, said bath having sufficient width to provide substantially horizontal nonturbulent flow of coagulating liquid toward said orifice and having no more than a minor portion of the total coagulating liquid lower than the entrance of said orifice within the area of nonturbulent flow adjacent to said orifice, the orifice having a length to diameter ratio of 3 or less and the cross-sectional area of the orifice being such as to provide a mass flow ratio of quench liquid/polymer of 25–200.

2. The process of claim 1 wherein the volume of coagulating liquid lower than the orifice entrance is less than 10% of the coagulating liquid in the area of nonturbulent flow.

3. The process of claim 1 wherein there is no coagulating liquid in the area of nonturbulent flow lower than the orifice entrance.

4. The process of claim 1 wherein the orifice is followed immediately by a jet device whereby additional coagulating liquid is applied symmetrically about the filaments in a downward direction forming an angle $\theta$ of 0° to 85° with respect to the filaments within 2.0 milliseconds from the time the filaments enter the orifice, the total flow rate of both overflowing coagulating liquid and additional coagulating liquid being maintained constant such that the momentum ratio $\theta$ is from 0.5 to 6.0 and the mass flow ratio of total quench liquid/polymer is 25–200.

5. The process of claim 3 wherein the depth of the coagulating liquid in the coagulating bath measured from the level of its upper surface to the orifice entrance is less than 1 inch (2.54 cm.).

6. The process of claim 5 wherein the depth of coagulating liquid in the coagulating bath is less than 0.625 inch (1.6 cm.).

* * * * *